US008105113B2

(12) United States Patent
Jozwiak

(10) Patent No.: US 8,105,113 B2
(45) Date of Patent: Jan. 31, 2012

(54) FUSE ADAPTER

(75) Inventor: Andrew Joseph Jozwiak, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/764,618

(22) Filed: Apr. 21, 2010

(65) Prior Publication Data

US 2011/0263161 A1 Oct. 27, 2011

(51) Int. Cl.
*H01R 13/00* (2006.01)

(52) U.S. Cl. ..... 439/620.31; 439/620.26

(58) Field of Classification Search . 439/620.26–620.34
See application file for complete search history.

(56) References Cited

U.S. PATENT DOCUMENTS 2,988,617 A * 6/1961 Graziosi ..... 337/197
4,275,374 A * 6/1981 Chaucer ..... 337/197
4,767,339 A * 8/1988 Comerci ..... 439/716
4,988,969 A * 1/1991 Gurevich ..... 337/260
5,116,246 A * 5/1992 Perry et al. ..... 439/620.34
5,125,855 A * 6/1992 Brooks ..... 439/620.33
5,174,788 A * 12/1992 Herbert ..... 439/532
5,281,171 A * 1/1994 Job ..... 439/620.26
5,324,214 A * 6/1994 De Castro ..... 439/620.26
5,476,396 A * 12/1995 De Castro ..... 439/692
5,951,328 A * 9/1999 Roper, Jr. ..... 439/620.27
6,089,918 A * 7/2000 Arakelian et al. ..... 439/620.27
6,482,050 B1 * 11/2002 Lemke et al. ..... 439/856
6,666,723 B2 * 12/2003 Fukumori et al. ..... 439/620.26
6,726,506 B2 * 4/2004 Fukumori et al. ..... 439/620.26
2008/0030294 A1 2/2008 Jozwiak

* cited by examiner

*Primary Examiner* — Briggitte R Hammond
(74) *Attorney, Agent, or Firm* — Paul W. Thiede

(57) ABSTRACT

A fuse adapter adapts coplanar blades of fuse having a predetermined blade spacing to fit a pair of coplanar blade receiving terminal slots in a circuit having a different slot spacing. The fuse adapter includes a pair of adapter terminals. Each adapter terminal has a slotted, planar upper end spaced from the other terminal's slotted upper end by the fuse blade spacing. Each adapter terminal upper end also has an adjusting tab bent away from the upper end substantially perpendicular thereto and substantially parallel to the plane of the coplanar terminal slots. Each adjusting tab is integral with a transition portion that extends to an adapter blade. The two adapter blades are coplanar with and spaced apart to match the fuse blade receiving terminal slots in the circuit.

17 Claims, 4 Drawing Sheets

FUSE ADAPTER

TECHNICAL FIELD

This invention is directed to a fuse adapter. More particularly, the fuse adapter adapts coplanar blades of a fuse having a predetermined spacing to fit a pair of coplanar receiving terminal slots having a different slot spacing.

BACKGROUND OF INVENTION

It is known, according to U.S. Pat. No. 6,726,506 issued on Apr. 27, 2004 and referring to prior art FIGS. 1 and 2, to use a fuse holder 1 mounted to a printed circuit board 2 that holds a fuse 3 in a fuse holder 1. The fuse 3 is used in an electric circuit (not shown) disposed on a printed circuit board 2. The fuse holder 1 includes connecting parts 4 to receive blade terminals 5 in connection with a body 6 of a fuse 3. Connecting parts 4 disposed in the fuse holder 1 are in electrical connection with corresponding contacts 7. Contacts 7 are mounted to a printed circuit board 2 to connect fuse 3 with the electric circuit (not shown). Each blade terminal 5 has a centerline and a corresponding width between the centerlines of the blade terminals 5. The width of the blade terminals 5 of the fuse 3 is the same width between a centerline on each of the contacts 7 mounted to the circuit board 2.

Vehicle electrical/electronic content continues to increase while the packaging for this electrical content continues to decrease requiring smaller fuse devices, or fuse circuit elements to support the increased electrical content. For example, five millimeter fuses will soon be employed in vehicle power distribution systems. These are so called due to a 5 millimeter centerline-to-centerline spacing. Five millimeter fuses may not be commonly available to consumers wanting to replace a blown fuse. Wider fuses, such as 8.2 millimeter fuses, are more generally available.

Therefore, what is needed is reliable fuse adapter that mates a commonly available wider fuse to a narrower fuse spacing.

SUMMARY OF THE INVENTION

According to one aspect of the invention, a fuse adapter is provided to adapt a fuse having a pair of coplanar blades with a predetermined blade spacing to fit to a pair of coplanar blade receiving terminal slots in a circuit having a different slot spacing. The fuse adapter includes a pair of adapter terminals. An upper end of each adapter terminal is spaced apart by the predetermined fuse blade spacing. Each upper end of the adapter terminals also has an adjusting tab bent away from the upper end substantially perpendicular thereto and substantially parallel to the plane of the coplanar receiving terminal slots. Each adjusting tab is integral with a transition portion on the adapter terminal that extends to an adapter blade. The two adapter blades on the respective adapter terminals are coplanar with and are spaced apart to match the fuse blade receiving terminal slots in the circuit.

According to an another aspect of the invention, a multi-fuse adapter includes a pair of adapter terminals and a center adapter terminal that cooperate to adapt a plurality of fuses each of which have coplanar blades with a predetermined blade spacing to fit with corresponding blade receiving terminal slots having a different slot spacing between each blade receiving terminal slot.

In still yet another aspect of the invention, a terminal is provided that includes at least one slotted, planar upper end, an adjusting tab in connection with the at least one upper end, a transition portion extending away from the adjusting tab, and an adapter blade in connection with the transition portion.

BRIEF DESCRIPTION OF THE DRAWINGS

This invention will be further described with reference to the accompanying drawings in which.

DETAILED DESCRIPTION

Disclosed herein is a fuse adapter that receives a fuse containing coplanar blade terminals having a predetermined spacing and adapts the predetermined spacing to fit in blade receiving terminals having a different spacing between the blade receiving terminals such as may be found in an electrical center or circuit board. Once the fuse adapter is installed in the electrical center with the fuse received in the fuse adapter, the received fuse electrically operates as an active circuit element in an electronic circuit. A multi-fuse adapter is also disclosed that receives a plurality of fuses that each have coplanar blade terminals having a predetermined blade spacing and the multi-fuse adapter adapts each fuse in the plurality of fuses to blade receiving terminals that have a different spacing from the predetermined blade spacing between each blade receiving terminal. The fuse adapter and multi-fuse adapter may be configured to receive commonly available fuses having amperage sizes that are widely commercially available for use in motor vehicle applications and consumer electronics.

Figure 1:
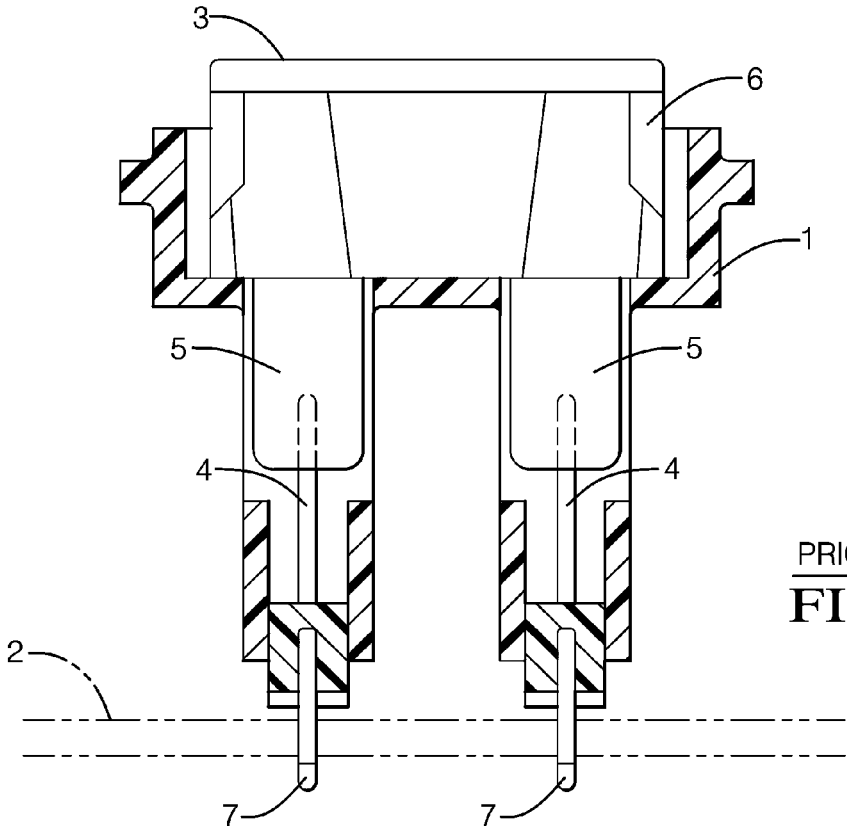
PRIOR ART FIG. 1
FIG. 1 is a cross section front view of a prior art fuse holder.
Figure 2:
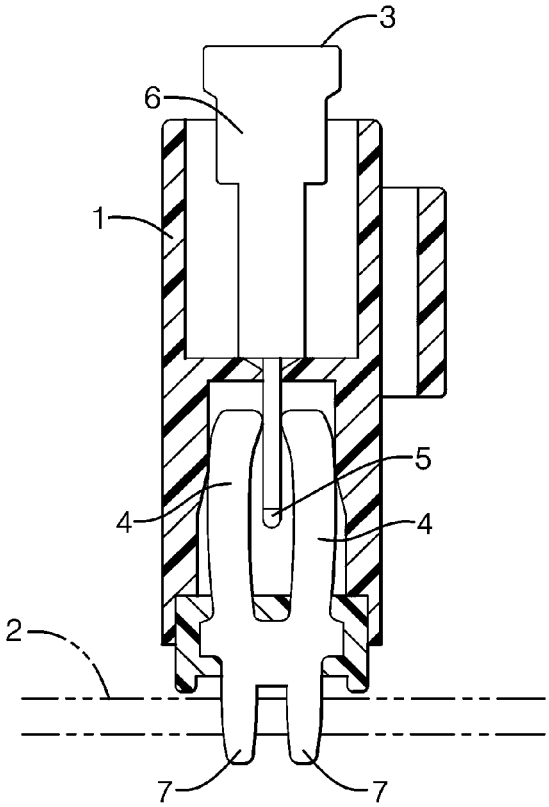
PRIOR ART FIG. 2
FIG. 2 is a cross section side view of the prior art fuse holder of FIG. 1.
Figure 3:
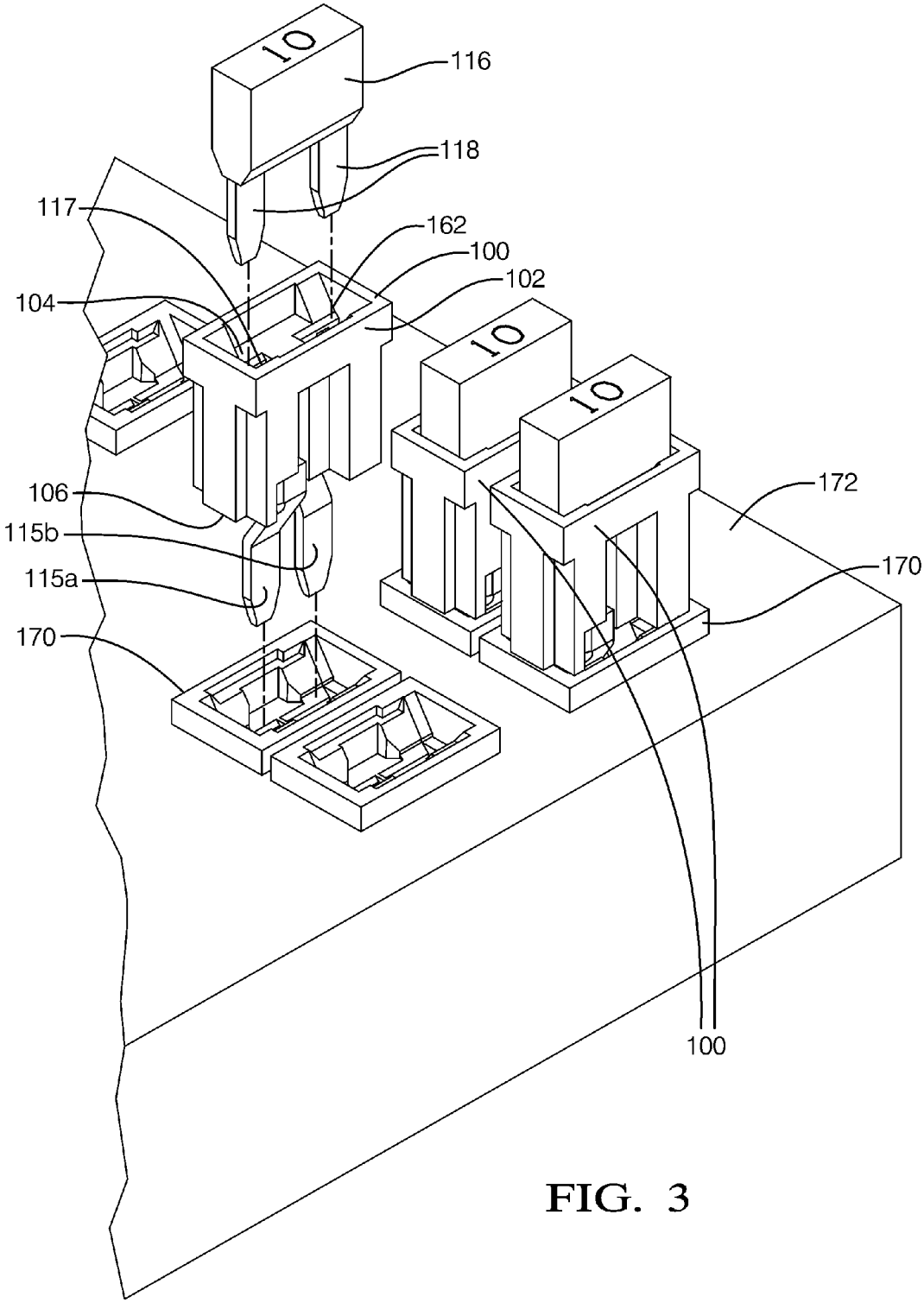
FIG. 3 is an exploded, perspective view of a fuse being inserted into the fuse adapter in accordance with an exemplary embodiment of the invention, and the fuse adapter fitted with the fuse is subsequently inserted into a receptacle of an electrical center.
Figure 4:
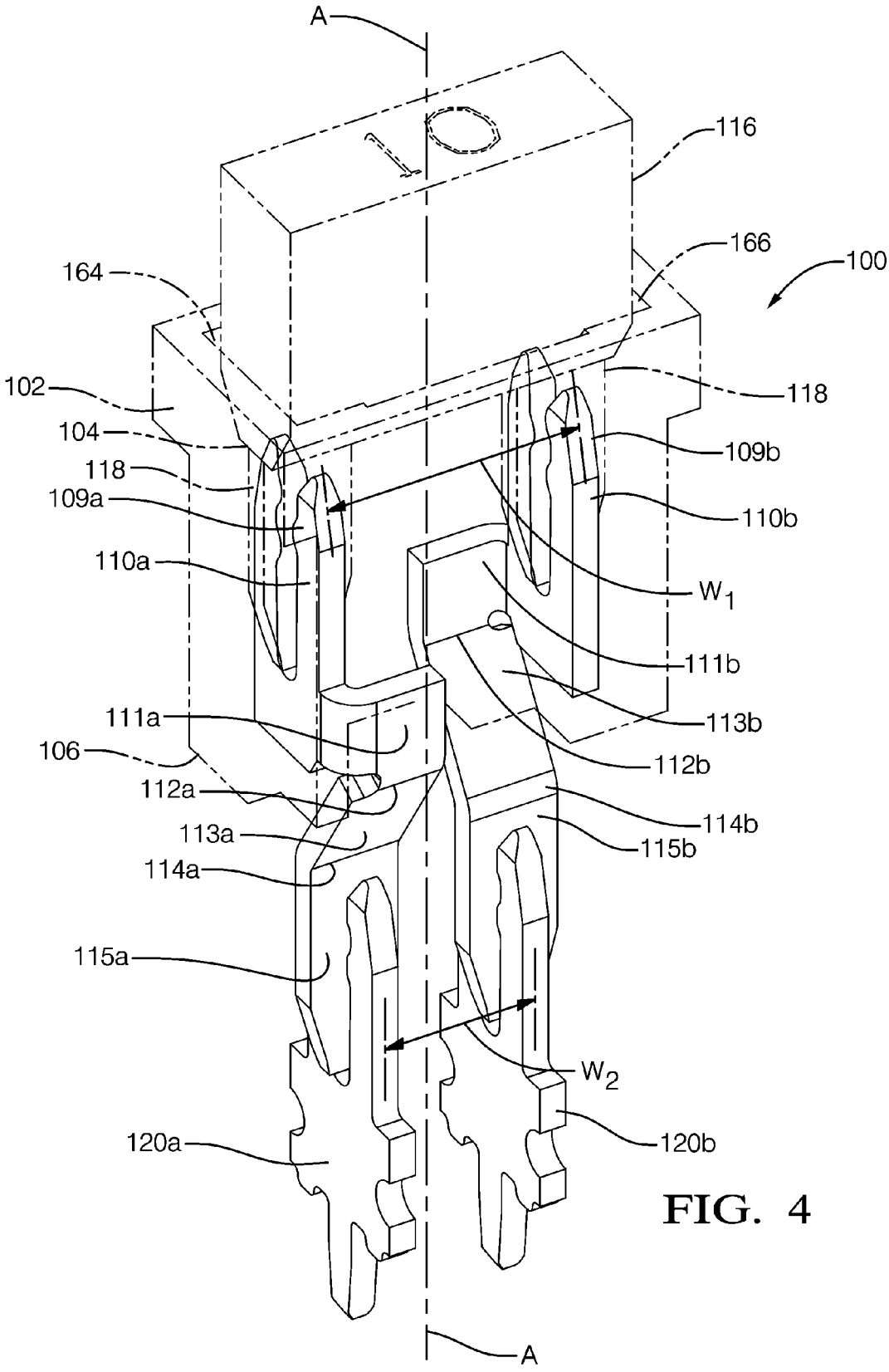
FIG. 4 is a perspective view of the fuse adapter of FIG. 3 showing inner terminal arrangement details thereof, and the fuse and the housing are shown in phantom line.

Referring now to the drawings where like numerals indicate like or corresponding parts throughout the views and exemplary embodiments are illustrated. Referring to FIGS. 3 and 4, fuse adapter 100, according to the invention, is populated in a receptacle 170 in an electrical center 172. As illustrated, electrical center 172 includes a plurality of fuse adapters including received fuses therein. A fuse receiving end 104 of fuse adapter 100 receives a fuse 116 containing blade terminals 118 having a predetermined centerline-to-centerline blade spacing, or a first width $w_1$ between blade terminals 118 and adapts this to fit a different spacing, or a second width $w_2$ between the receiving terminal slots in receptacle 170 of electrical center 172. Fuse adapter 100, including received fuse 116 in cavity 164, is inserted into receiving terminals 120*a*, 120*b* disposed in corresponding receiving terminal slots for a circuit (not shown) in electrical connection with receptacle 170.

Referring to FIG. 4, fuse adapter 100 includes a housing 102 disposed along a longitudinal axis A. Housing 102 includes fuse receiving end 104 and a terminal end 106 axially remote from fuse receiving end 104. Housing 102 is formed of an electrically nonconductive material, preferably a material such as a plastic resin, a thermoplastic, and the like.

A pair of adapter terminals 109*a*, 109*b* are disposed axially in housing 102. One of the pair, or first adapter terminal 109*a* is an integral terminal that includes a slotted, planar upper end 110*a*, an adjusting tab 111*a*, a transition portion 113*a*, and an adapter blade 115*a*. Upper end 110*a* defines a slot forming a tuning fork-type shape that allows upper end 110*a* to receive blade terminal 118. Adjusting tab 111*a* is bent away from upper end 110*a* substantially perpendicular to upper end 110*a*. Adjusting tab 111*a* is integral with transition portion 113*a* and transition portion 113*a* extends in a direction away from adjusting tab 111*a*. Adapter blade 115*a* is in connection with transition portion 113*a*. Adapter blade 115*a* axially extends in a direction away from transition portion 113*a*. Transition portion 113*a* also extends away from terminal end 106 of housing 102. A first bend 112*a* forms a transition interface between adjusting tab 111*a* and transition portion 113*a*. A second bend 114*a* forms another transition interface between transition portion 113*a* and adapter blade 115*a*. First adapter terminal 109*a* is electrically conducting and is formed by a stamping manufacturing operation from a sheet of metal base material made of plated or unplated copper alloy, and the like. Additional forming and bending manufacturing operations on the stamped metal piece configures the metal piece into first adapter terminal 109*a* as discussed herein. A first aperture 117 is defined in housing 102 proximate upper end 110*a* disposed within cavity 164 at fuse receiving end 104. Aperture 117 provides access to receive blade terminal 118 of fuse 116 from outside housing 102 to connect with upper end 110*a*.

Another one of the pair of adapter terminals, or second adapter terminal 109*b* is also disposed in housing 102. Second adapter terminal 109*b* is identical to first adapter terminal 109*a* and is formed from material and constructed like first adapter terminal 109*a*, as described previously herein. Using the identical terminal for both adapter terminals may decrease design and manufacturing costs for the fuse adapter. Elements of second adapter terminal 109*b* that are similar to first adapter terminal 109*a* have similar element numbers that differ by a similar, different letter designator. Second adapter terminal 109*b* is spaced apart from first adapter terminal 109*a* in a direction perpendicular to axis A. Second adapter terminal 109*b* also includes a slotted, planar upper end 110*b*, an adjusting tab 111*b*, a transition portion 113*b*, and an adapter blade 115*b*, and bends 112*b*, 114*b*. A second aperture 162 is defined in fuse receiving end 104 to provide access to upper end 110*b* of second adapter terminal 109*b* from outside of housing 102 similar to first aperture 117. Adapter terminals 109*a*, 109*b* are configured in housing 102 with a centerline-to-centerline spacing between upper end 110*a* and upper end 110*b* being first width $w_1$ which matches the predetermined centerline-to-centerline spacing between blade terminals 118 of fuse 116. Adapter terminals 109*a*, 109*b* are also configured in housing 102 such that adapter blades 115*a*, 115*b* are spaced apart by second width $w_2$ and are coplanar to match with coplanar receiving terminals 120*a*, 120*b* in receiving slots of electrical center 172. Housing 102 is configured around terminals 109*a*, 109*b* to ensure terminals 109*a*, 109*b* maintain first width $w_1$ and second width $w_2$. Adjusting tabs 111*a*, 111*b* are substantially parallel with the plane of coplanar adapter blades 115*a*, 115*b*.

First adapter terminal 109*a* has a first orientation in housing 102 and second adapter terminal 109*b* has a second orientation different from the first orientation in housing 102. The second orientation includes second adapter terminal 109*b* being rotated, or mirrored about the plane of coplanar receiving terminals 120*a*, 120*b*. Thus, terminal 109*b* is rotated about the plane receiving terminals 120*a*, 120*b* being 180 degrees out of phase with terminal 109*a*. Thus, upper end 109*a* mirrors upper end 109*b* and adjusting tabs 111*a*, 111*b* have a mirroring opposing relationship through axis A in housing 102. Upper ends 110*a*, 110*b* of first and second adapter terminals 109*a*, 109*b* are adapted to receive blade terminals 118 of blade-type fuse 116.

Cavity 164 of housing 102 is defined in fuse receiving end 104 and overlies first and second adapter terminal 109*a*, 109*b*. Cavity 164 includes an open end 166 adjacent fuse receiving end 104. Open end 166 is configured to receive a body of fuse 116 upon insertion of blade terminals 118 through apertures 117, 162 in cavity 164. Cavity 164 provides a cradle for the body of fuse 116.

Housing 102 of fuse adapter 100 has a rectangular shape about axis A. Alternately, the housing may be formed of any desired shape. Preferably, the fuse adapter may be manufactured with the first adapter terminal being fitted, or inserted into the first aperture and the second adapter terminal being fitted, or inserted into the second aperture in the housing. After insertion of the terminals into the housing, the housing deflects around the terminals to snap-lock and secure the terminals in place, as is known in the art. Alternately, the terminals may be press-fit into the apertures in the housing. Housing 102 is configured to enclose and secure at least upper ends 110*a*, 110*b* of first and second adapter terminal 109*a*, 109*b*. Housing 102 is configured to assist in maintaining the centerline-to-centerline spacing of first width $w_1$ between the upper ends 110*a*, 110*b* and the centerline-to-centerline spacing of second width $w_2$ of adapter blades 115*a*, 115*b*. Still yet alternately, the fuse adapter may be manufactured with the housing being molded around the first and the second adapter terminal.

Housing 102 defines first width $w_1$ perpendicular to axis A between a centerline-to-centerline spacing of upper ends 110*a*, 110*b*. Housing 102 defines second width $w_2$ perpendicular to axis A between a centerline-to-centerline spacing of adapter blades 115*a*, 115*b* that match the different spacing between receiving terminals 120*a*, 120*b* of electrical center 172. First width $w_1$ is not the same width as second width $w_2$. Alternately, first width $w_1$ is greater than second width $w_2$. Preferably, width $w_1$ is about 8.2 millimeters and width $w_2$ is about 5 millimeters. The 8.2 millimeter width between blade terminals of the fuse is associated with fuses that are commonly commercially available in the marketplace for purchase at locations like retail part supply outlets. Thus, a commonly available 8.2 millimeter fuse may be used in product applications with the fuse adapter to fit a 5 millimeter fuse terminal spacing that would not otherwise accommodate the 8.2 millimeter fuse. Still yet alternately, width $w_1$ is substantially 8.2 millimeters and width $w_2$ is substantially 5 millimeters. The fuse adapter may be used in any application requiring a fuse having a first width to be implemented in a product application having a second width that is not the same as the first width. The fuse adapter may find widespread use in many electrical/electronic applications in the transportation, agriculture, and marine industries.

When blade terminals 118 of fuse 116 are received in slots of upper ends 110*a*, 110*b* of first and second adapter terminal 109*a*, 109*b*, blade terminals 118 in the slots of upper ends 110*a*, 110*b* have a coplanar relationship with adapter blades 115*a*, 115*b*. Adjusting tabs 111*a*, 111*b* and transition portions 113*a*, 113*b* are not in the plane defining the coplanar relationship between upper ends 110*a*, 110*b* and adapter blades 115*a*, 115*b*. Adjusting tabs 111*a*, 111*b*, transition portions 113*a*, 113*b*, and bends 112*a*, 112*b*, 114*a*, 114*b* cooperate to allow blade terminals 118 of fuse 116 received in slots of upper ends 110*a*, 110*b* and adapter blades 115*a*, 115*b* to have a coplanar relationship while also allowing first width $w_1$ to not be the same width as second width $w_2$.

Referring to FIG. 3, when adapter blades 115*a*, 115*b* of first and second adapter terminal 109, 109*b* are not in electrical connection with fuse receiving terminals 120*a*, 120*b*, fuse adapter 100 is not in use and does not electrically operate. Referring to FIGS. 3 and 4, fuse adapter 100 is in use when adapter blades 115*a*, 115*b* of first and second adapter terminal 109*a*, 109*b* are in electrical connection with fuse receiving terminals 120*a*, 120*b* in receptacle 170, such as when fuse adapter 100 is inserted and received into a receptacle 170 of a fuse block, or electrical center 172. If fuse 116 is not received in upper ends 110*a*, 110*b* when adapter blades 115*a*, 115*b* are installed in fuse receiving terminals 120*a*, 120*b*, the fuse adapter does not affect electrical operation in an electrical circuit (not shown) electrically connected with receiving terminals 120*a*, 120*b*. Insertion of fuse 116 through apertures 117, 162 in fuse receiving end 104 allow for electrical connection of blade terminals 118 with upper ends 109*a*, 109*b* of adapter terminals 109*a*, 109*b* of fuse adapter 100 such that fuse adapter 100 does electrically operate with receiving terminals 120*a*, 120*b*. Electrical connection of fuse 116 in fuse adapter 100 ensures electrical connection with receiving terminals 120*a*, 120*b* and the electrical circuit (not shown) in electrical communication with electrical center 172. Alternately, the fuse may be initially inserted into the fuse adapter followed by the fuse adapter with the received fuse being inserted in to the receptacle of the electrical center.

Figure 5:
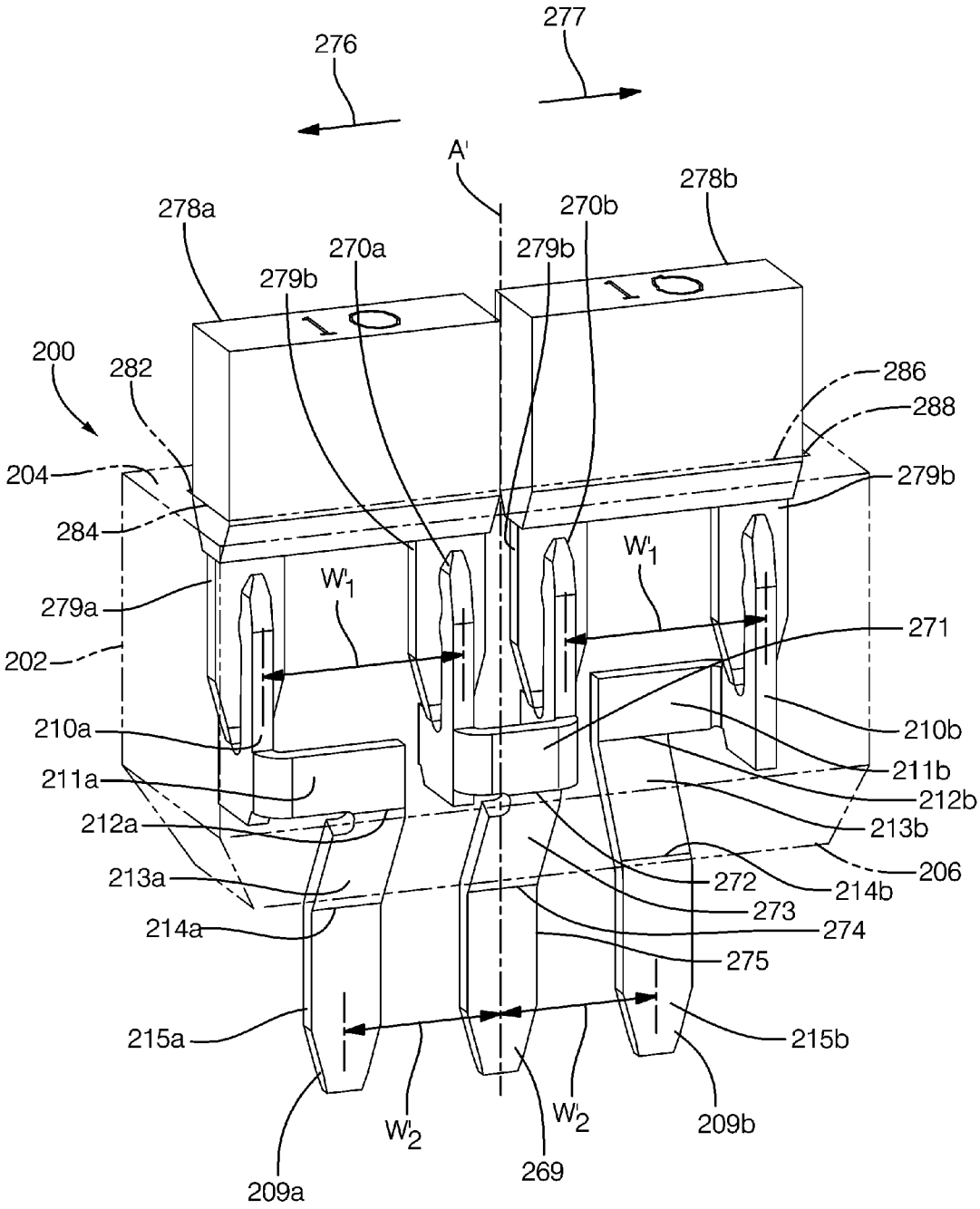
FIG. 5 is a perspective view of the terminal arrangement of the multi-fuse adapter showing the details thereof, according to an another exemplary embodiment of the invention, and the fuse and the housing are shown in phantom line.

Referring to FIG. 5, in accordance with another embodiment of the invention, a multi-fuse adapter 200 is provided. Where the structure of multi-fuse adapter 200 in the embodiment of FIG. 5 is similar with the structure of fuse adapter 100 in the embodiment of FIG. 4, element numbers are marked differing by 100 and are previously described herein. Multi-fuse adapter 200 includes a housing 202 disposed along a longitudinal axis A', a first and a second adapter terminal 209*a*, 209*b*, and a center adapter terminal 269. Multi-fuse adapter 200 has a similar construction to the embodiment of FIG. 4 previously described herein. Multi-fuse adapter 200 may be useful when two or more fuses are needed for electrical connection with corresponding adjacent fuse receiving terminals in a fuse electrical center or circuit board where a first width $w_1'$ of the predetermined spacing of each of the fuses is not the same width as a different spacing, or second width $w_2'$ between each of the fuse receiving terminals.

Center adapter terminal 269 is coaxially disposed in housing 202 intermediate first adapter terminal 209*a* and second adapter terminal 209*b*. Center adapter terminal 269 is formed by a stamping manufacturing operation similar to the embodiment of FIG. 4. Additional forming and bending manufacturing operations on the stamped metal piece further configures center adapter terminal 269 as discussed herein. First adapter terminal 209*a* is spaced apart from center adapter terminal 269 in a first direction 276 and second adapter terminal 209*b* is spaced apart from center adapter terminal 269 in a second direction 277 opposite first direction 276. First adapter terminal 209*a* is identical with second adapter terminal 209*b*. Center adapter terminal 269 includes a pair of slotted, planar upper ends 270*a*, 270*b*. Upper ends 270*a*, 270*b* are in connection with an adjusting tab 271 adjoining upper ends 270*a*, 270*b*. Adjusting tab 271 is in connection with transition portion 273 disposed about midway between upper ends 270*a*, 270*b*. Adapter blade 275 is in connection with transition portion 273 and remote from upper ends 270*a*, 270*b*. A first and a second aperture (not shown) are defined in fuse receiving end 204 to allow blade terminals 279*a*, 279*b* of fuses 278*a*, 278*b* to access the corresponding upper ends 210*a*, 210*b* of adapter terminals 209*a*, 209*b*. A third aperture (not shown) is also defined in fuse receiving end 204 to provide access to allow blade terminals 279*a*, 279*b* of fuses 278*a*, 278*b* to be received in upper ends 270*a*, 270*b*. Alternately, the third aperture may further include a third aperture to access upper end 270*a* in first cavity 284 and a fourth aperture to access other upper end 270*b* in second cavity 288. Cavities 284 and 288 combine to form a single cavity in an open end 282. Alternately, the housing may contain distinct cavities that receive the plurality of fuses. Each cavity may be separated from other cavities in the housing by a portion of the housing. Transition portion 273, in connection with adapter blade 275 of center adapter terminal 269, protrudes away from housing 202 at terminal end 206. Terminals 209*a*, 269, 209*b* are constructed into housing 202 in a similar manner as the first and the second adapter terminal as previously described in the embodiment of FIG. 4. Housing 202 is configured to enclose at least upper ends 210*a*, 270*a*, 270*b*, 210*b* of adapter terminals 209*a*, 269, 209*b*.

Each fuse 278*a*, 278*b* has corresponding coplanar blades 279*a*, 279*b* having a predetermined blade spacing, or a first width $w_1'$. Coplanar blade receiving terminal slots (not shown) have a different spacing from first width $w_1'$ between each slot in the plurality of receiving slots which is a second width $w_2'$. The centerline-to-centerline spacing between upper end 210*a* and upper end 270*a* is first width $w_1'$ which is the same as the predetermined centerline-to-centerline spacing of blade terminals 279*a* of first fuse 278*a*. The centerline-to-centerline spacing between upper end 270*b* and upper end 210*b* is first width $w_1'$ which is the same as the predetermined centerline-to-centerline spacing of blade terminals 279*b* of second fuse 278*b*. Likewise, the centerline-to-centerline spacing between adapter blade 215*a* and adapter blade 275 is second width $w_2'$ and the centerline-to-centerline spacing between adapter blade 275 and adapter blade 215*b* is also second width $w_2'$ which matches the different spacing between blade receiving terminals (not shown) in the receiving terminal slots (not shown). First width $w_1'$ is not the same width as second width $w_2'$. Preferably, first width $w_1'$ is greater than second width $w_2'$. More particularly, first width $w_1'$ is 8.2 millimeters and second width $w_2'$ is 5 millimeters for the reasons previously described herein in the embodiment of FIG. 4. Alternately, first width $w_1'$ is substantially 8.2 millimeters and second width $w_2'$ is substantially 5 millimeters. Adjusting tabs 211*a*, 271, 211*b* are substantially parallel with the plane of coplanar adapter blades 215*a*, 275, 215*b* and receiving terminals (not shown). Housing 202 cooperates with adapter terminals 209*a*, 269, 209*b* to maintain the spacing of first width $w_1'$ and second width $w_2'$. Adjusting tabs 211*a*, 271, 211*b*, transition portions 213*a*, 273, 213*b*, and bends 212*a*, 272, 212*b*, 214*a*, 274, 214*b* all cooperate to allow blade terminals 279*a*, 279*b* of fuses 278*a*, 278*b* received in slots in upper ends 210*a*, 270*a*, 270*b*, 210*b* and adapter blades 215*a*, 275, 215*b* to have a coplanar relationship while allowing first width $w_1'$ to not be the same width as second width $w_2'$.

Insertion of first fuse 278*a* through open end 282 of a first cavity 284 and through the first and the third aperture (not shown) in fuse receiving end 204 allows electrical connection of blade terminals 279*a* of first fuse 278*a* with the slot in upper end 210*a* on first adapter terminal 209*a* and the slot in upper end 270*a* on center adapter terminal 269. The body of first fuse 278*a* is subsequently cradled in first cavity 284 overlying upper ends 210*a*, 270*a* of respective first and center adapter terminal 209*a*, 269. Insertion of second fuse 278*b* through an open end 286 of a second cavity 288 and through second and the third aperture (not shown) in fuse receiving end 204 allows electrical connection of blade terminals 279*b* of second fuse 278*b* with the slot in upper end 270*b* on center adapter terminal 269 and the slot in upper end 210*b* on second adapter terminal 209*b*. The body of second fuse 278*b* is subsequently cradled in second cavity 288 overlying upper ends 270*b*, 210*b* of respective center and second adapter terminal 269, 209*b*.

Referring to FIG. 5, the slots in upper ends 210*a*, 270*a*, 270*b*, 210*b* are in coplanar relationship with adapter blades 215*a*, 275, 215*b* and adjusting tabs 211*a*, 271, 211*b* and transition portions 213*a*, 273, 213*b* are not in the coplanar relationship. The center adapter terminal may typically be in electrical connection with a power source electrically connected with the electrical center and common to both fuses received in the fuse adapter.

First adapter terminal 209*a* has a first orientation in housing 202 and second adapter terminal 209*b* has a second orientation in housing 202. One of the pair of adapter terminals 209*b* is mirrored about the plane of the receiving terminal slots (not shown) in housing 202 in relation to the other one of the pair of adapter terminals 209*a*. Thus, one of the pair of adapter terminals 209*b* is disposed in the housing rotated, or mirrored 180 degrees out of phase with the other one of the pair of adapter terminals 209*a*.

Alternately, the upper ends on the adapter terminals may be formed and configured to any shape that receives a terminal of a fuse. More particularly, the upper end may include any female-type configuration that receives a bladed device. For example, the upper end may be configured as a blade-type terminal that is configured to be fitted with a female-to-female device. A blade-type terminal of a fuse may then be received into the other end of the female-to-female device.

Yet alternately, the adapter blades of the terminals of the fuse adapter may be configured to be any shape that may be received by an electrical center or circuit board device, and the like. More particularly, the adapter blades may include any male-type configuration that is inserted into electrical center or circuit board device, and the like.

In another alternate embodiment, one or more of the terminals in the fuse adapter and multi-fuse adapter may each have different design constructions.

In a further alternate embodiment, the terminals of the fuse adapter and the multi-fuse adapter may be utilized without a housing in a product application to receive the fuses and directly connect into an electrical center or printed circuit board.

In yet another alternate embodiment, the bare adapter terminals of the fuse adapter and multi-fuse adapter may be separated by any spacing means different from a housing to ensure the predetermined blade spacing between blades of a fuse and/or the different slot spacing of the receiving terminal slots is maintained. For example, a plastic rib may join the adapter terminals together to assist to maintain the different spacing between the blade receiving terminals while the fuse is inserted into the upper ends to maintain the predetermined spacing of the blade terminals of the fuse.

In another alternate embodiment, the bare adapter terminals may be used without any structure to receive fuses and be directly inserted into the receiving terminals in the receiving terminal slots of an electrical center.

In a further alternate embodiment, the upper ends of the fuse adapter and multi-fuse may be further configured to allow the fuse adapter and the multi-fuse adapter to receive different fuse types such as mini-type or maxi-type fuses, low profile fuses, and the like.

In an another alternate embodiment, adapter blades of a fuse and a multi-fuse adapter may be further configured to mount the fuse adapter to structures other than electrical centers where electrical circuits are employed, such as printed circuit boards, and the like.

In another further alternate embodiment, a multi-fuse adapter may be configured to receive and electrically connect more than two fuses with circuits electrically connected with an electrical center or printed circuit board.

In yet another further alternate embodiment, the disposition of the upper ends of the center adapter terminal relative to each other on the multi-fuse adapter may be further adapted to form a plurality of configurations in cooperation with the placement of the respective first and second adapter terminals in the housing dependent on the product application. For example, if one of the upper ends of the center adapter terminal is offset from the other upper end of the center adapter terminal in a direction perpendicular to the axis, and the upper end of the first adapter terminal is aligned with one of the upper ends of the center adapter terminal and the upper end of the second adapter terminal is aligned with the other upper end of the center adapter terminal, this configuration allows placement of a first fuse in the receiving fuse end of the multi-fuse adapter to be offset from the second fuse in the receiving fuse end of the multi-fuse adapter. This configuration may then be fitted into receiving terminals of an electrical center that are similarly offset. Other configurations in the plurality of the configurations are left to the artesian.

Thus, the invention provides for a reliable fuse adapter that receives a commonly available fuse having a predetermined spacing, or a first width between the blade terminals of the fuse and adapts the predetermined spacing to a different spacing, or a second width between each of the blade receiving terminals in an electrical center. A commonly available 8.2 millimeter fuse, used in conjunction with the fuse adapter, allows the larger 8.2 millimeter fuse to service a blown fuse having a narrower five millimeter fuse receiving terminal slot spacing in an electrical center. Utilizing adapter blades on the first and second adapter terminal of the fuse adapter allows the fuse adapter to directly fit into receiving terminals in a receptacle of an electrical center. The orientation of the adapter terminals in the housing using a single terminal design eliminates the need to manufacture other additional terminal designs so as to reduce design and manufacturing costs for the fuse adapter. Fitted construction of the adapter terminals within the housing provides ease of manufacturing of the fuse adapter. The fuse adapter may be utilized for connection to electrical centers and circuit boards, and the like, wherever a fuse circuit element needs to be employed where blade terminals on the fuse having the predetermined spacing adapt to a different spacing between each receiving terminal. Slots in the upper ends of the adapter terminals are coplanar with the adapter blades of the adapter terminals to allow an insertion force of the fuse adapter into an electrical center or circuit board to be concentrated along a central plane with the receiving terminals in the electrical center to allow ease of insertion of the fuse adapter without additional stress being placed on the fuse or the adapter terminals in the housing of the fuse adapter. A multi-fuse adapter is provided to allow two or more fuses having blade terminals with a predetermined spacing of the first width to be received into the multi-fuse adapter and the multi-fuse adapter employed where additional fuse capability having a plurality of blade receiving terminals with a different spacing between each of the receiving terminals being the second width is required.

While the present invention has been shown and described with reference to certain preferred embodiments thereof, it will be understood by those skilled in the art that various changes in form and details may be made therein without departing from the spirit and scope of the present invention as defined by the appended claims.

All terms used in the claims are intended to be given their broadest ordinary meanings and their reasonable constructions as understood by those skilled in the art unless an explicit indication to the contrary is made herein. In particular, use of the singular articles such as "a," "the," "said," . . . et cetera, should be read to recite one or more of the indicated elements unless a claim recites an explicit limitation to the contrary.

I claim:

1. A fuse adapter for adapting a fuse having a pair of coplanar blades with a predetermined blade spacing to fit to a pair of coplanar blade receiving terminal slots in a circuit having a different slot spacing, comprising:

a pair of adapter terminals, each adapter terminal having a slotted, planar upper end spaced from the other terminal's slotted upper end by said predetermined blade spacing, each adapter terminal upper end also having an adjusting tab bent away from the upper end substantially perpendicular thereto and substantially parallel to a plane defined through the coplanar terminal slots, each adjusting tab being integral with a transition portion that extends towards and directly connects with an adapter blade, the two adapter blades being coplanar with and spaced apart by said different slot spacing to match the blade receiving terminal slots in said circuit.

2. The fuse adapter according to claim 1, wherein said predetermined blade spacing between the respective upper ends is greater than said different slot spacing between the respective adapter blades.

3. The fuse adapter according to claim 2, wherein said predetermined blade spacing between the respective upper ends is about 8.2 millimeters and said different slot spacing between the respective adapter blades is about 5 millimeters.

4. The fuse adapter according to claim 1, further including, a housing surrounding at least the upper ends of the pair of adapter terminals, wherein the housing is adapted to ensure the pair of adapter terminals maintain said predetermined blade spacing between the upper ends and said different slot spacing between the adapter blades.

5. The fuse adapter according to claim 1, wherein one of the pair of adapter terminals is identical with the other one of the pair of adapter terminals.

6. The fuse adapter according to claim 1, wherein one of the pair of adapter terminals is mirrored about the plane of the receiving terminal slots in the housing in relation to the other one of the pair of adapter terminals, whereby the one of the pair of adapter terminals is disposed in the housing 180 degrees out of phase with the other one of the pair of adapter terminals.

7. The fuse adapter according to claim 1, wherein the slots in the upper ends of the pair of adapter terminals have a coplanar relationship with the adapter blades of the pair of adapter terminals.

8. The fuse adapter according to claim 7, wherein the adjusting tabs and the transition portions of the adapter terminals are not in the coplanar relationship.

9. A multi-fuse adapter for adapting a plurality of fuses where each fuse has a pair of coplanar blades with a predetermined blade spacing to fit with a plurality of coplanar blade receiving terminal slots in a circuit including a different slot spacing between each terminal slot, comprising:

a center adapter terminal including a pair of slotted, planar upper ends with one of the upper ends spaced apart from the other upper end by an adjusting tab joining the pair of upper ends, and the adjusting tab being bent away from each of the upper ends of the pair of upper ends substantially perpendicular thereto and substantially parallel to the plane of the coplanar terminal slots; and a pair of adapter terminals with one adapter terminal spaced apart from the center adapter terminal in first direction and the other adapter terminal spaced apart from the center adapter terminal in a second direction opposite the first direction, and each adapter terminal having a slotted upper end being coplanar with the pair of upper ends on the center adapter terminal and each upper end of the pair of adapter terminals also having an adjusting tab bent away from the upper end of each adapter terminal substantially perpendicular thereto and substantially parallel to the plane of the coplanar terminal slots, each adjusting tab of the terminals being integral with a transition portion that extends to an adapter blade, the three adapter blades being coplanar with and spaced apart to match the plurality of blade receiving terminal slots in said circuit.

10. The multi-fuse adapter according to claim 9, wherein said predetermined blade spacing is greater than said different slot spacing.

11. The multi-fuse adapter according to claim 10, wherein said predetermined blade spacing is about 8.2 millimeters and said different slot spacing is about 5 millimeters.

12. The multi-fuse adapter according to claim 9, further including, a housing surrounding at least the pair of upper ends of the center adapter terminal and the upper ends of the pair of adapter terminals, wherein the housing is adapted to ensure the center adapter terminal and the pair of adapter terminals maintain the predetermined blade spacing and the different slot spacing.

13. The multi-fuse adapter according to claim 12, wherein the housing defines one of a cavity and a plurality of cavities to receive the plurality of fuses.

14. The multi-fuse adapter according to claim 9, wherein one of the pair of adapter terminals is identical with the other one of the pair of adapter terminals.

15. The fuse adapter according to claim 9, wherein one of the pair of adapter terminals is mirrored about the plane of the receiving terminals slots in the housing in relation to the other one of the pair of adapter terminals, whereby the one of the pair of adapter terminals is disposed in the housing 180 degrees out of phase with the other one of the pair of adapter terminals.

16. The fuse adapter according to claim 9, wherein the slots in the upper ends of the pair of adapter terminals and the center adapter terminal are in a coplanar relationship with the adapter blades of the pair of adapter terminals and the center adapter terminal.

17. The multi-fuse adapter according to claim 16, wherein the adjusting tabs and the transition portions of the adapter terminals are not in the coplanar relationship.

* * * * *